US009053837B2

(12) United States Patent
Holland

(10) Patent No.: US 9,053,837 B2
(45) **Date of Patent: *Jun. 9, 2015**

(54) PROTECTED COAXIAL CABLE

(71) Applicant: HOLLAND ELECTRONICS, LLC, Ventura, CA (US)

(72) Inventor: Michael Holland, Santa Barbara, CA (US)

(73) Assignee: Holland Electronics, LLC, Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/201,876

(22) Filed: Mar. 9, 2014

(65) Prior Publication Data

US 2014/0187080 A1 Jul. 3, 2014

Related U.S. Application Data

(63) Continuation-in-part of application No. 12/634,293, filed on Dec. 9, 2009, now Pat. No. 8,308,505, and a continuation of application No. 13/022,592, filed on Feb. 7, 2011, now Pat. No. 8,692,116.

(51) Int. Cl.

| | |
|---|---|
| ***H01R 11/00*** | (2006.01) |
| ***H01B 7/08*** | (2006.01) |
| ***H01R 31/02*** | (2006.01) |
| *H01B 11/18* | (2006.01) |

(52) U.S. Cl.

CPC ..... *H01B 7/0869* (2013.01); *H01B 7/0838* (2013.01); *H01R 31/02* (2013.01); *H01B 7/0823* (2013.01); *H01B 11/1895* (2013.01)

(58) Field of Classification Search

CPC ..... H01B 7/0823; H01B 7/0838; H01R 31/02
USPC ..... 439/502; 174/117 F
See application file for complete search history.

(56) References Cited

U.S. PATENT DOCUMENTS

| | | | | |
|---|---|---|---|---|
| 4,313,029 | A | 1/1982 | Bunish | |
| 4,419,538 | A * | 12/1983 | Hansell, III | 174/117 F |
| 4,801,764 | A | 1/1989 | Ohlhaber | |
| 6,159,046 | A * | 12/2000 | Wong | 439/578 |
| 6,417,455 | B1 * | 7/2002 | Zein et al. | 174/117 F |
| 7,271,346 | B1 | 9/2007 | Ettinger et al. | |
| 7,314,998 | B2 | 1/2008 | Amato et al. | |
| 7,709,741 | B2 | 5/2010 | Reichert | |
| 7,736,181 | B1 * | 6/2010 | Benevento et al. | 439/585 |
| 8,308,505 | B2 * | 11/2012 | Hatton et al. | 439/502 |
| 8,692,116 | B2 * | 4/2014 | Holland | 174/117 F |
| 8,772,640 | B2 * | 7/2014 | Hatton et al. | 174/117 F |
| 2005/0092516 | A1 | 5/2005 | Chuo et al. | |
| 2011/0021069 | A1 | 1/2011 | Hu et al. | |

FOREIGN PATENT DOCUMENTS

| | | | |
|---|---|---|---|
| WO | WO2005008686 | A1 | 1/2005 |
| WO | WO2008096947 | A1 | 8/2008 |

* cited by examiner

*Primary Examiner* — Neil Abrams
*Assistant Examiner* — Travis Chambers
(74) *Attorney, Agent, or Firm* — Paul D. Chancellor; Ocean Law

(57) ABSTRACT

A guarded coaxial cable assembly includes a micro-coaxial cable and an adjacent structure for protecting the micro-coaxial cable.

13 Claims, 12 Drawing Sheets

PROTECTED COAXIAL CABLE

PRIORITY CLAIM

This application is a continuation-in-part of U.S. patent application Ser. No. 12/634,293 filed Dec. 9, 2009 now U.S. Pat. No. 8,308,505 issued Nov. 13, 2012 and U.S. patent application Ser. No. 13/022,592 filed Feb. 7, 2011.

BACKGROUND OF THE INVENTION

1. Field of the Invention

The present invention relates to an article of manufacture for conducting electrical signals. In particular, a guarded coaxial cable is provided for conducting radio frequency signals.

2. Discussion of the Related Art

Coaxial cables used for television including satellite, cable TV and antenna cables are typically 7 mm in diameter, a size large enough to limit signal loss over the distances traveled from an outside location to a location inside a home or building. Usually these cables originate outside a home or apartment such as a multiple dwelling unit (MDU) and terminate inside where TV, wireless, or satellite reception equipment is located.

A cable often enters a building through a hole drilled in a wall. But, drilling a hole in a wall and routing a cable through the hole makes a permanent alteration to the building. Since most MDU occupants do now own the premises, this simple action raises issues including unauthorized building modifications, ownership of cable modifications, liability for changes, and liability for related safety issues.

Wireless solutions do not solve this problem. While capacitive coupling solves the problem of transporting high frequency signals across a glass boundary, such wireless solutions are unable to transport mid and low frequency signals. In particular, cable and satellite television signals, electric powering of outdoor devices, and low frequency control signals must be transported using electrical conductors such as coaxial cables.

A solution using the space between a window or door and an adjacent frame is well known. Here, cables are passed through an existing opening without modification to the building structure. But, using such openings to pass a typical 7 mm O.D. coaxial cable presents challenges including; closing the window or door when it is blocked by the cable; and, maintaining a fully functional cable when it is deformed by impact and compression from operation of the window or door.

The gap between a window/door and its frame is typically less than the 7 mm size of the cable. In many windows and doors, the space provided for soft weather sealing material and/or the latching tolerance of the door/frame interface provides a gap on the order of about 3 mm. Therefore, a 7 mm coaxial cable in this application will likely be squeezed and damaged while a cable of 3 mm or smaller diameter will likely avoid damage.

Coaxial cable deformations are undesirable because they damage cable covering and abruptly change the coaxial cable conductor spacing. In particular, conductor spacing changes tend to alter the characteristic impedance of the cable and reflect radio frequency power back toward the source, causing a condition called standing waves. An abrupt change in impedance acts as a signal bottleneck and may result in detrimental data delays and signal lock-ups found in satellite TV signal transmission systems.

Coaxial cable entry solutions face a variety of problems including one or more of: 1) traveling through a small space between the closed window/door and its frame; 2) destruction or degradation from impacts when windows or doors are operated; 3) functioning within its specifications, for example a DBS Satellite coaxial cable must maintain a minimum impedance matching of the RF signal (12 dB minimum return loss at 2150 MHz) in order for the home device to operate correctly; and, 4) passing electric current such as a DC current to power an outside device and low frequency control signals when needed.

The present methods of solving these problems lie in the construction of an extension cable that can pass through the small space and have coaxial connectors at each end to re-fasten the larger 7 mm coaxial long distance transmission cable at each end. These methods include using coaxial cables with diameters in the range of 3-4 mm, using armor such as metallic armor and other armoring methods known to persons of ordinary skill in the art, and flattening a coaxial cable to provide a thin profile.

None of these methods provides a robust solution. The first method often fails to protect the cable since cables over 3 mm in diameter are larger than typically available window/door to frame gaps. When the door or window is closed, these cables are deformed to varying degrees rendering them useless and/or degrading their RF performance. In addition, the outer covering on such cables is soft and easily breached by repeated operation of windows/doors.

The second method using armor not only uses cables larger than 3 mm, it also prevents the cable from making sharp turns such as 90 degree bends typical of the window and door frame applications. Here, the minimum bending radius of the extender cable is unacceptably increased by the armor.

The third method using a flattened/non-circular coaxial cable provides inferior RF performance even before it is installed. In addition, bending the flat coaxial cable to accommodate one or more sharp bends of window/door frames further distorts the cable cross-section and impairs signal transmission. Further, the soft sheath of a coaxial cable can easily be breached by repetitive impacts from operation of windows/doors.

What is needed is a guarded coaxial cable assembly having features including one or more of the following: 1) a cable assembly providing good RF performance including meeting industry standards such as 10 dB return loss, for a 75 ohm impedance, at a highest frequency of about 2150 MHz; 2) the cable assembly safely passing DC currents up to about 1.5 amperes with acceptable and/or minimal loss; 3) the cable assembly able to make multiple 90 degree bends to fit into the door frame; and, 4) the cable assembly performing within its specifications despite repeated impacts from windows/doors.

While known solutions are widely employed and the cable and satellite television industry shows little interest in developing new solutions, the present invention offers significant advancements over what has been done before.

SUMMARY OF THE INVENTION

In the present invention, a guarded coaxial cable assembly includes a micro-coaxial cable and a nearby rail or bumper member. In some embodiments, at least a portion of the assembly can be deformed to assume and substantially maintain a plurality of different shapes. In various embodiments, the invention provides for one or more of an improved method of transporting RF signals, DC current, and low frequency control signals via a guarded coaxial cable assembly and transporting the same through a confined space such as the gap between doors/windows and an adjacent frame member.

In an embodiment, a cable assembly comprises a rail extending alongside a nearby micro-coaxial cable; the rail and the micro-coaxial cable are embedded in a jacket; the jacket has a pair of generally opposed bearing surfaces for bearing transverse loads; the rail is operative to reduce jacket deformations resulting from transverse loads applied to the bearing surfaces; and, the orientation of the rail and the micro-coaxial cable within the jacket are operative to reduce cable deformations resulting from transverse loads applied to the bearing surfaces.

In another embodiment, a cable assembly comprises a rail extending alongside a nearby micro-coaxial cable; the rail and the micro-coaxial cable are embedded in a jacket; the jacket has a pair of generally opposed bearing surfaces for bearing transverse loads; the rail is operative to reduce jacket deformations resulting from transverse loads applied to the bearing surfaces; and, the orientation of the rail and the micro-coaxial cable within the jacket are operative to reduce cable deformations resulting from transverse loads applied to the bearing surfaces.

In another embodiment, a cable assembly includes a micro-coaxial cable extending between two plates in spaced apart relationship; a cableway is formed from the plates and the micro-coaxial cable is encased in a substantially flat jacket; the plates are located within the jacket to guard the micro-coaxial cable against transverse loads tending to further flatten the jacket; and, the rail, micro-coaxial cable, and jacket materials are flexible and in combination operative to enable the cableway to substantially retain deformations consistent with bending a flat side of the cableway around obstructions.

In another embodiment, a cable assembly includes a cableway formed from a length of micro-coaxial cable and a jacket; the jacket has a central portion encasing the micro-coaxial cable and first and second peripheral portions adjoining the central portion; the jacket central portion has a first thickness and the jacket peripheral portions have a thickness of at least a second thickness; and, the second thickness is greater than the first thickness and the peripheral portions are operative to preferentially bear transverse loads tending to flatten the jacket.

In another embodiment, a cable assembly includes a micro-coaxial cable, a plate, and a jacket extending along a length of the cable assembly; the jacket mechanically couples the plate and the micro-coaxial cable; the jacket is operable to distribute transverse forces applied to the cable assembly and to limit compression of the micro-coaxial cable; and, the micro-coaxial cable, plate, and jacket are flexible and in combination operative to enable the cable assembly to substantially retain deformations consistent with bending the cable assembly around obstructions.

In another embodiment, a cable assembly includes an elongated member including two arms and a cross-member; the arms extend from opposed sides of the cross-member and form an elongated pocket; a micro-coaxial cable is positioned at least partially within and extending along a length of the pocket; and, the arms, cross-member, and micro-coaxial cable are flexible and in combination operative to enable the cable assembly to substantially retain deformation consistent with bending the cable assembly around obstructions.

And, in yet another embodiment, a cable assembly includes an elongated member including two flanges and a cross-member; the flanges extend from opposed sides of the cross-member and form first and second elongated pockets; a micro-coaxial cable is positioned at least partially within and extending along a length of the first pocket; and, the flanges, cross-member, and micro-coaxial cable are flexible and in combination operative to enable the cable assembly to substantially retain deformation consistent with bending the cable assembly around obstructions.

BRIEF DESCRIPTION OF THE DRAWINGS

The present invention is described with reference to the accompanying figures. These figures, incorporated herein and forming part of the specification, illustrate non-limiting embodiments of the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of embodiments they disclose. For example, other embodiments of the disclosed device and/or method may or may not include the features described herein. Moreover, disclosed advantages and benefits may apply to only certain embodiments of the invention and should not be used to limit the disclosed invention.

To the extent parts, components and functions of the described invention exchange electric power or signals, the associated interconnections and couplings may be direct or indirect unless explicitly described as being limited to one or the other. Notably, parts that are connected or coupled may be indirectly connected and may have other devices interposed therebetween including devices known to persons of ordinary skill in the art.

Figure 1:
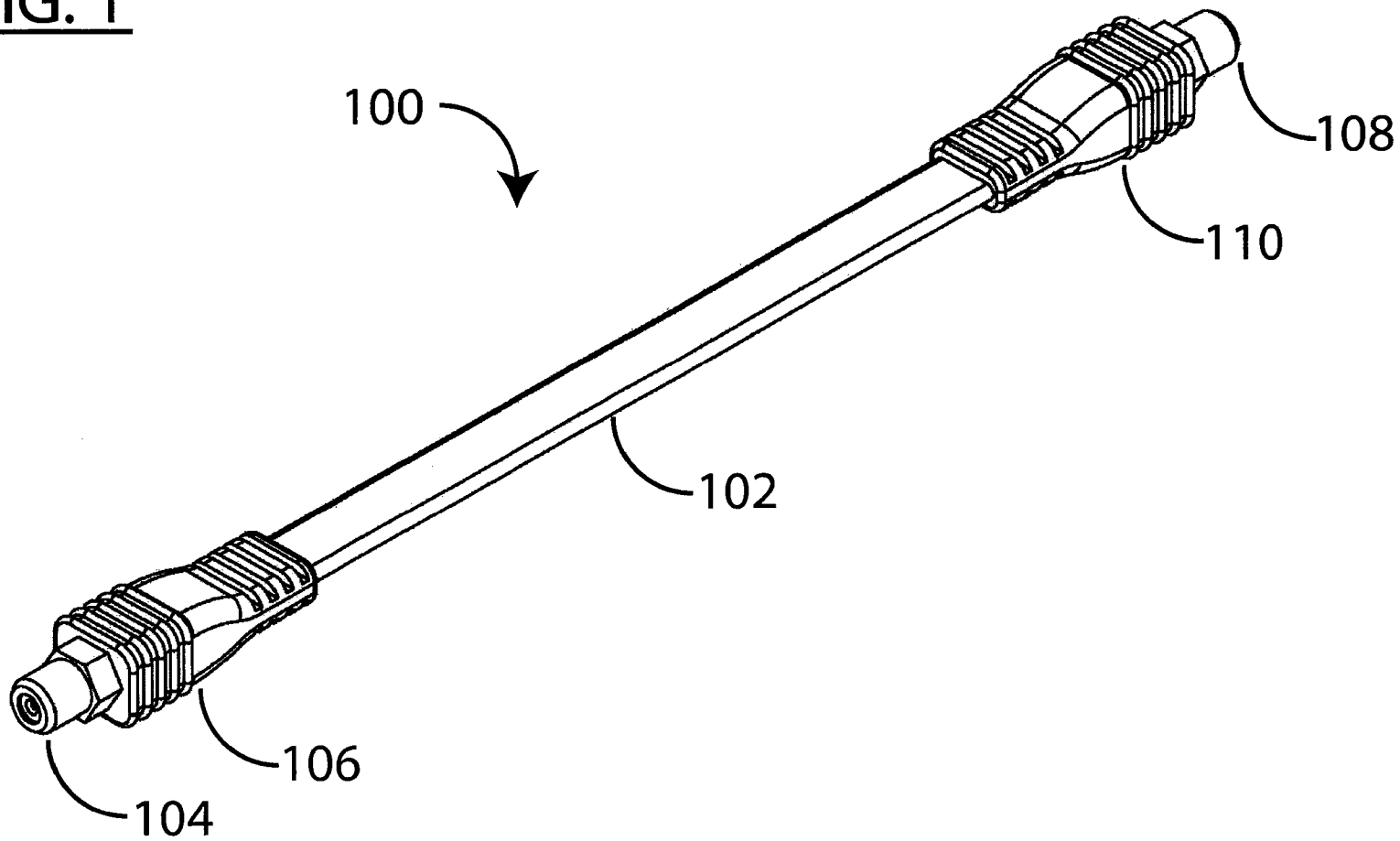
FIG. 1 shows a guarded coaxial cable assembly in accordance with the present invention.

FIG. 1 shows a guarded coaxial cable assembly in accordance with the present invention 100. A cableway such as a substantially flat cableway 102 interconnects and extends between first and second connectors 104, 108. In some embodiments, over-moldings or boots 106, 110 surround an interface between each connector and the cableway. In some embodiments, auxiliary connectors with respective auxiliary leads are included (not shown).

Figure 2:
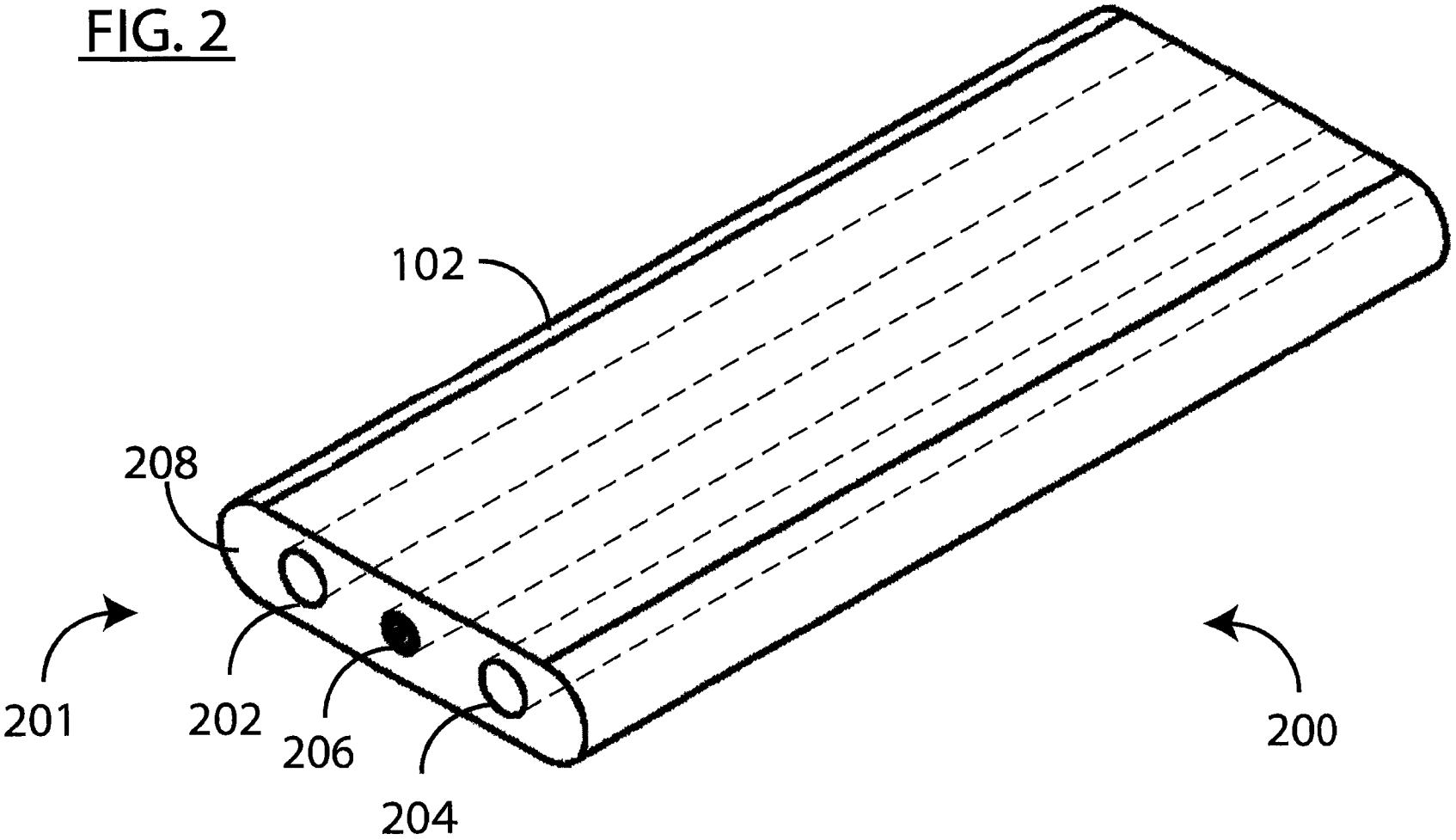
FIG. 2 shows a section of the cableway of the guarded coaxial cable assembly of FIG. 1.

FIG. 2 shows a perspective view of a portion of the cableway 200. An exposed end of the cableway 201 reveals a cross-section including a micro-coaxial cable 206, one or more rails (two shown) 202, 204 and a cableway jacket such as a matrix 208. In an embodiment, a centerline of the micro-coaxial cable lies substantially along an imaginary surface defined by a plurality of imaginary lines of shortest distance extending between the rails.

Any suitable coaxial cable connectors 104, 108 known to persons of ordinary skill in the art may be used with the micro-coaxial cable 206. In an embodiment, "F" type coaxial cable connectors are used. In other embodiments, BNC or RCA type connectors are used. In either case, the connectors may be male, female or mixed. In an embodiment, the guarded coaxial cable assembly includes female connectors on each end for interconnection with the male connectors of another coaxial cable such as a larger feeder RF cable.

Figure 3:
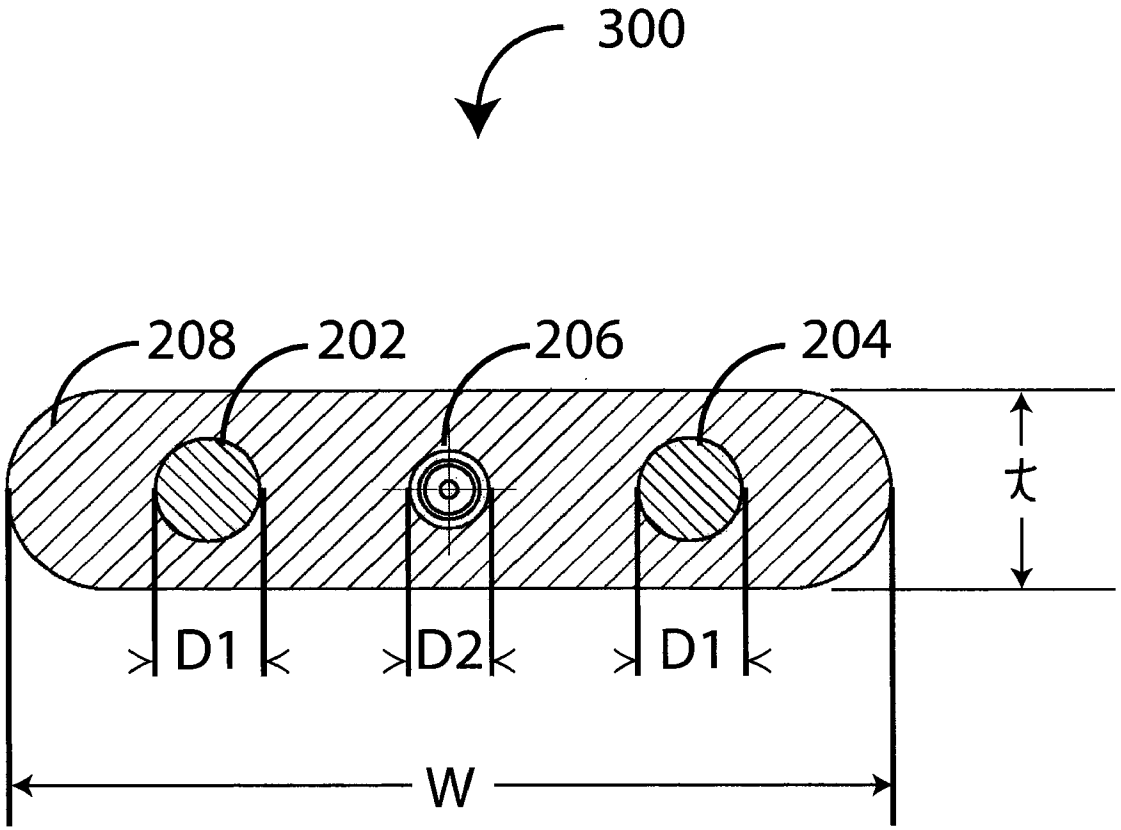
FIG. 3 shows an enlarged cross-section of the cableway of the guarded coaxial cable assembly of FIG. 1.

FIG. 3 shows an enlarged cross-sectional view of a cableway 300. In the embodiment shown, the jacket 208 is substantially flat having a thickness "t" suitable for location in narrow passages such as between a door and a door frame and/or jamb or a window and a window frame and/or sill. In various embodiments, the jacket thickness is in the range of about 2 to 5 mm. And, in an embodiment, the jacket thickness is about 3 mm.

The cableway width "w" is selected such that the outer jacket envelops the micro-coaxial cables and the rails. In an embodiment, the jacket width is in the range of about 2×(D1+D1+D2) to 5×(D1+D1+D2) where D1 is the outer diameter of each rail and D2 is the outer diameter of the micro-coaxial cable 206. And, in various embodiments, the jacket width is in the range of about 10-14 mm. And, in an embodiment, the jacket width is about 12 mm.

Materials suited for use as jackets include flexible, non-conducting and abrasion resistant materials. A number of polymers, including one or more of rubber, silicon, PVC, polyethylene, neoprene, chlorosulfonated polyethylene, and thermoplastic CPE, are used in various embodiments.

Construction methods for integrating the jacket 208, rails 202, 204 and micro-coaxial cable 206 include any suitable method known to persons of ordinary skill in the art. In an embodiment, the jacket 208 is tubular and envelops the micro-coaxial cable 206 and rail(s) 202, 204. In another embodiment, the jacket envelops the rail(s) and micro-coaxial cable as it is extruded from a die.

In some embodiments (as shown), the jacket 208 envelopes the rails 202, 204 and micro-coaxial cable 206 and fills the spaces between them. In yet another embodiment, the assembly 300 is molded such as by filling a mold holding the micro-coaxial cable 206 and rail(s) 202, 204 with a fluid that will solidify and become the jacket. Suitable fluids include fluids useful in making the above polymers and other fluids useful for making suitable jacket materials and known to persons of ordinary skill in the art.

Figure 4:
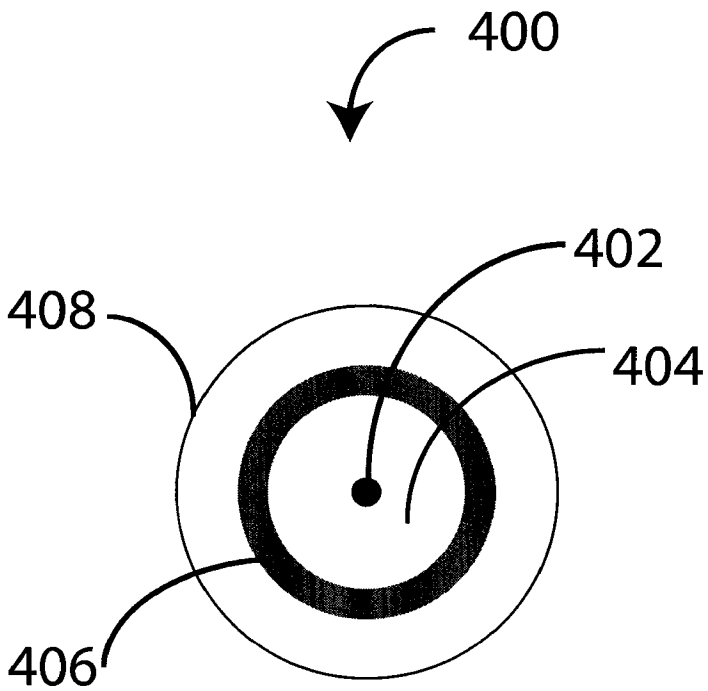
FIG. 4 shows an enlarged cross-section of a coaxial cable of the guarded coaxial cable assembly of FIG. 1.

FIG. 4 shows a cross-sectional view of a micro-coaxial cable 400. A dielectric material 404 separates a central conductor 402 and a conductive ground sheath 406 and the sheath is surrounded by a protective non-conducting outer sheath 408. The selected micro-coaxial cable should be appropriate for the intended service, such as cable TV or feeds from Direct Broadcast Satellite receiving dishes for example.

In an embodiment, the invention includes use of 75 ohm micro-coaxial cable having an outside diameter less than 2 mm which can make a 90 degree bend in a small space such as around door and window framing and maintain true coaxial performance. The micro cable is protected from radial impact and abrasion by a protective outer sheath.

Exemplary micro-coaxial cables include MCX™ brand cables sold by Hitachi Cable Manchester. In some embodiments the micro-coaxial cable outer sheath 408 includes a non-stick material such as Teflon® promoting relative motion between the cable and the cableway jacket 208.

Whether a single rail or two or more rails are used (two are shown) 202, 204, the rail(s) preferentially bear transverse loads applied to the cableway 102 and tend to prevent harmful compression of the micro-coaxial cable. In various embodiments, the diameter of the micro-coaxial cable D2 is greater than or equal to the diameter of the rails D1. In some of these embodiments, the ratio of the diameters D2/D1 is in the range of about 1.0 to 2.0.

In various other embodiments (as shown), the diameter of the micro-coaxial cable D2 is chosen to be somewhat less than the diameter of the rails D1 for added protection. In some of these embodiments, the ratio of diameters D1/D2 is in the range of about 1.0 to 2.0

Figure 5:
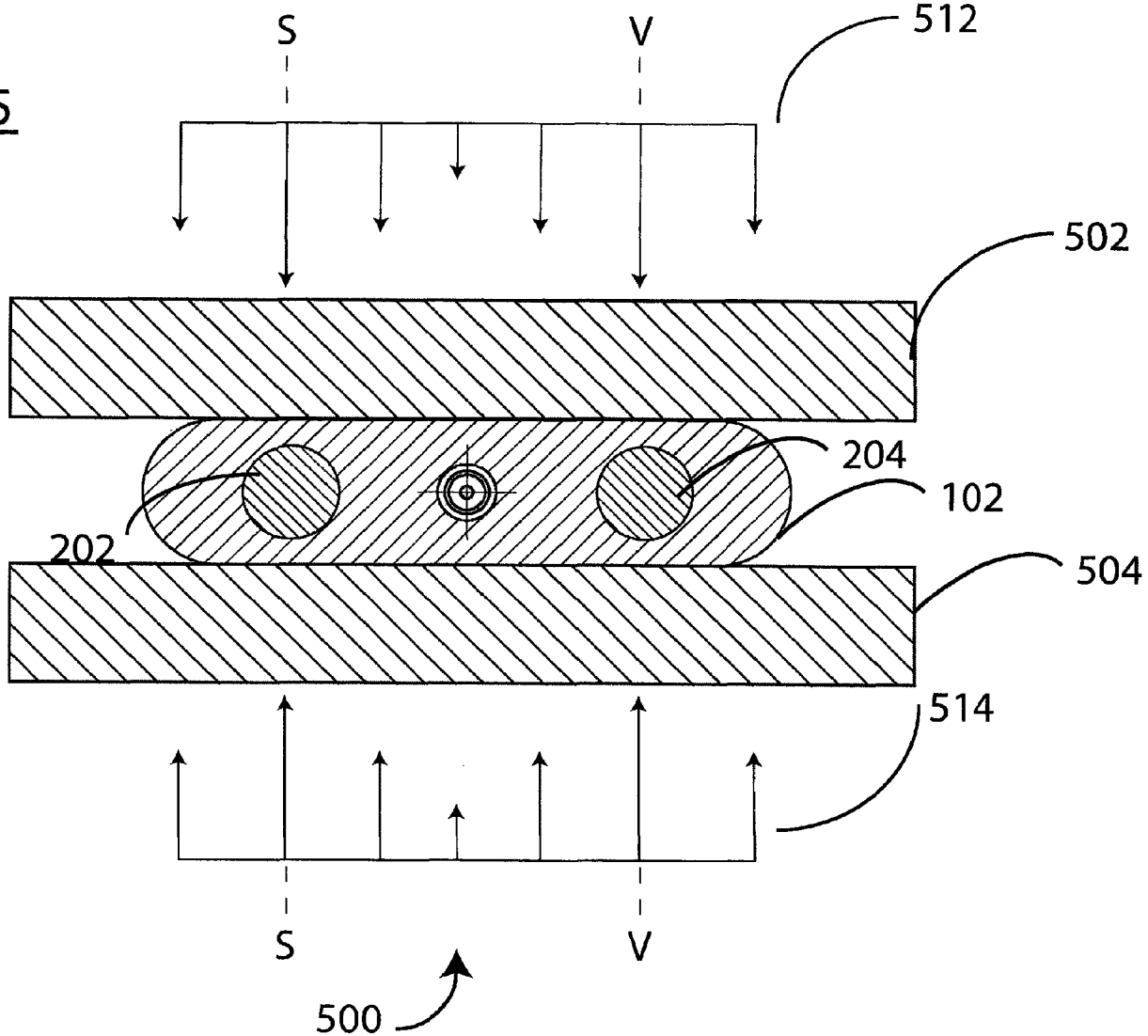
FIG. 5 shows forces applied to an enlarged cross-section of the cableway of the guarded coaxial cable assembly of FIG. 1.

FIG. 5 shows a portion of a cableway subjected to a load 500. In particular, the cableway 102 is squeezed between opposed passage parts 502, 504 tending to compress the cableway. Choosing rail materials that are relatively incompressible as compared to the cableway jacket materials results in most of the load being borne along and near lines s-s and v-v passing through the respective centers of the rails. An example of such a preferential force distribution is shown in opposed force profiles 512, 514.

Materials suited for rail construction are relatively incompressible as compared to cableway jacket materials. In some embodiments, rail construction materials are flexible. And, in some embodiments rail construction materials tend, at least partially, to retain deformed shapes such as an angular profile after being bent around a corner.

In various embodiments, rail construction materials include metals and metal alloys with one or more of iron, steel, copper, aluminum, tin, nickel and other metals known by persons of ordinary skill in the art to have suitable properties. In some embodiments, rail construction materials include non-metals such as polymers. For example, a segmented/articulated rail made from PVC can be used, the segments imparting flexibility and/or a tendency to retain, at least partially, a deformed shape.

In embodiments with conductive rail materials, the rails can serve as electrical conductors. As persons of ordinary skill in the art will understand, the power handling capability of the rails will be influenced by their physical and material properties and the connectors will be chosen to suit the application.

Uses for guarded coaxial cable assemblies include passing through gaps at windows and doors, and through other confined spaces where an unprotected coaxial cable might otherwise be damaged. As discussed above, such protection is desirable for, inter alia, preserving signal quality. And, as discussed above, various embodiments orient one or more rails 202, 204 and a micro-coaxial cable in a flat cableway 102 such that transverse loads applied to the cableway are preferentially borne by the rail(s).

Figure 6:
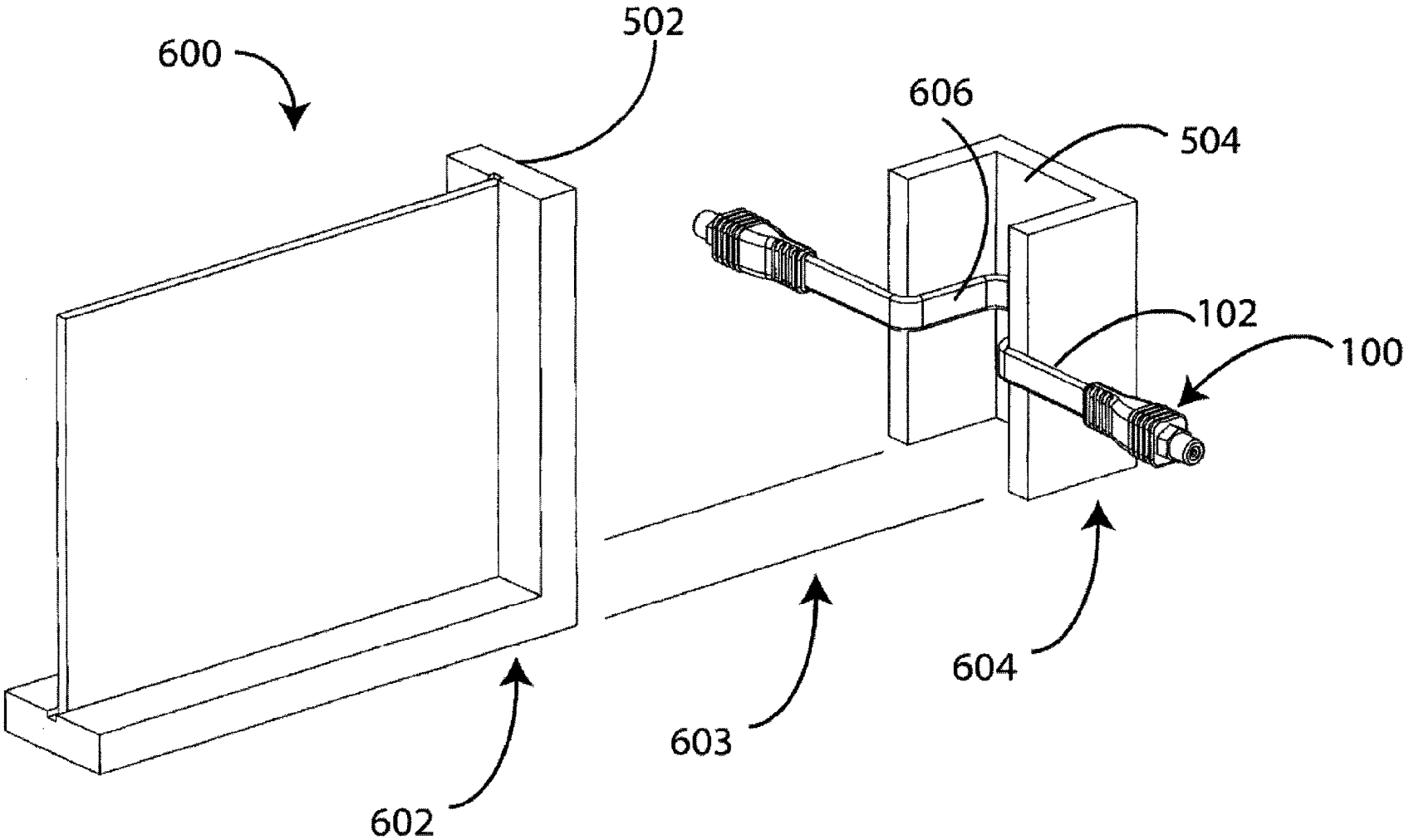
FIG. 6 shows the guarded coaxial cable assembly of FIG. 1 installed in a window or door frame.

FIG. 6 shows a guarded coaxial cable assembly installed in an open sliding window or door jamb 600. Here, the cable assembly passes between the opposed passage parts 502, 504 located on a respective sliding sash 602 and a fixed jamb 604. When the sash slides along a slide part 603, it presses a cableway section of the cable assembly 606 into a shape matching the "U" shaped profile of the confined space.

Figure 7:
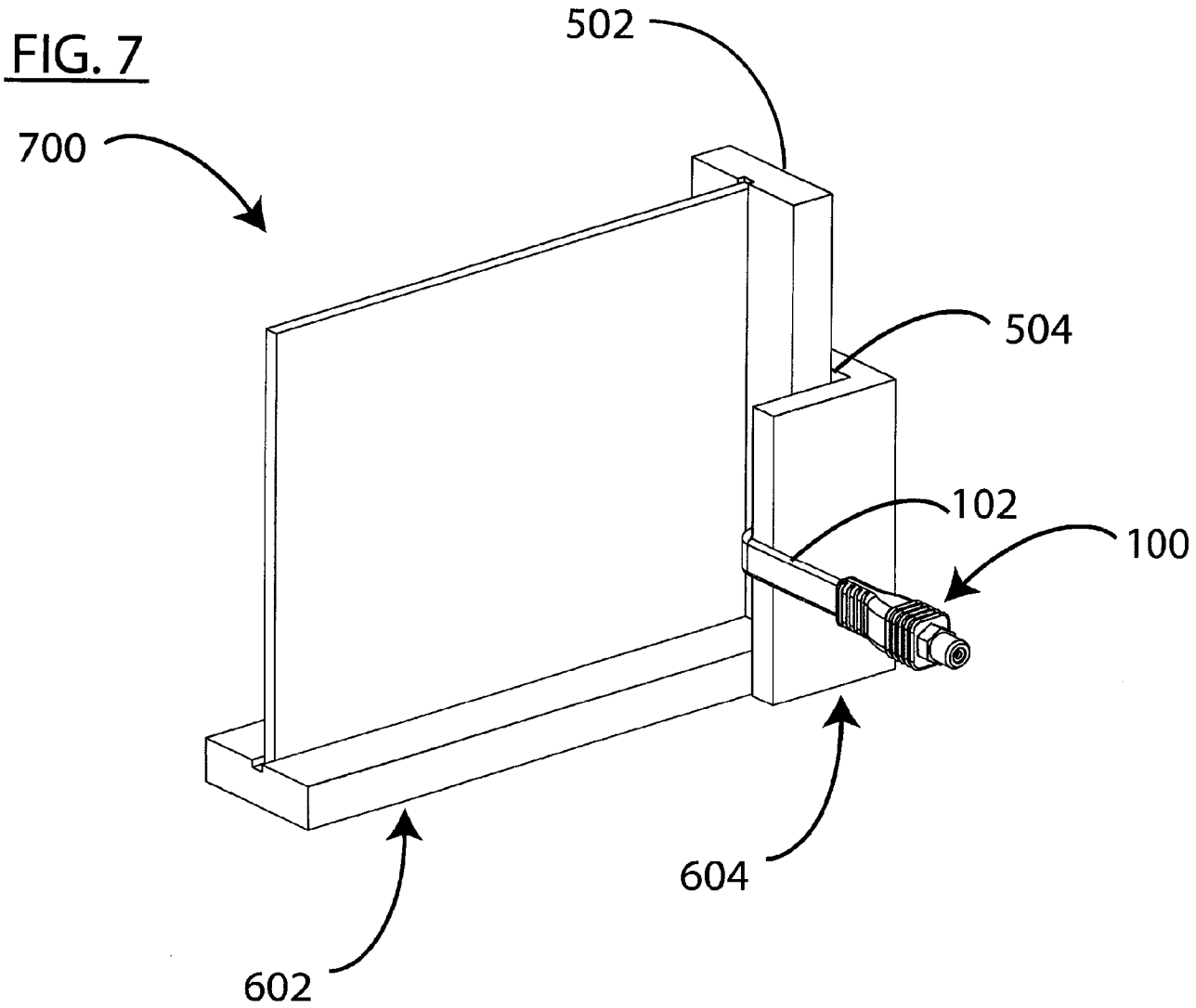
FIG. 7 shows the guarded coaxial cable assembly of FIG. 1 being squeezed by a closed window or door.

FIG. 7 shows a guarded coaxial cable assembly installed in a closed sliding window or door jamb 700. As described above in connection with FIG. 5, the rails 202, 204 of the cableway 102 guard the micro-coaxial cable 206 against compression and crushing due to closing the sash or door 602 and squeezing the cableway between the passage parts 502, 504.

Embodiments of the present invention include flat cableways such as the cableway 102 shown in FIGS. 2 and 7. And, embodiments of the present invention include two or more rails 202, 204 such as rails having a generally circular cross-section.

In other embodiments, a single rail or a rail formed at least in part by the jacket is used, any of which may be non-circular. And, in some embodiments, non-circular cross sections such as rectangular cross-sections are used. And, in other embodiments, the cableway is not flat. Rather, the cableway provides generally opposed bearing surfaces such as opposed sides of a square or an oval.

In various embodiments, one or more rails function to reduce jacket deformations resulting from the transverse loads applied to the bearing surfaces. Further, the orientation of a rail and the micro-coaxial cable within the jacket reduce cable deformations resulting from transverse loads applied to the bearing surfaces. In embodiments, a rail dimension about perpendicular to a longitudinal rail axis is smaller than a micro-coaxial cable diameter. And, in embodiments, a rail dimension about perpendicular to a longitudinal rail axis that is larger than a micro-coaxial cable diameter. Yet other embodiments of the guarded coaxial cable assembly of the present invention are discussed below.

Figure 8:
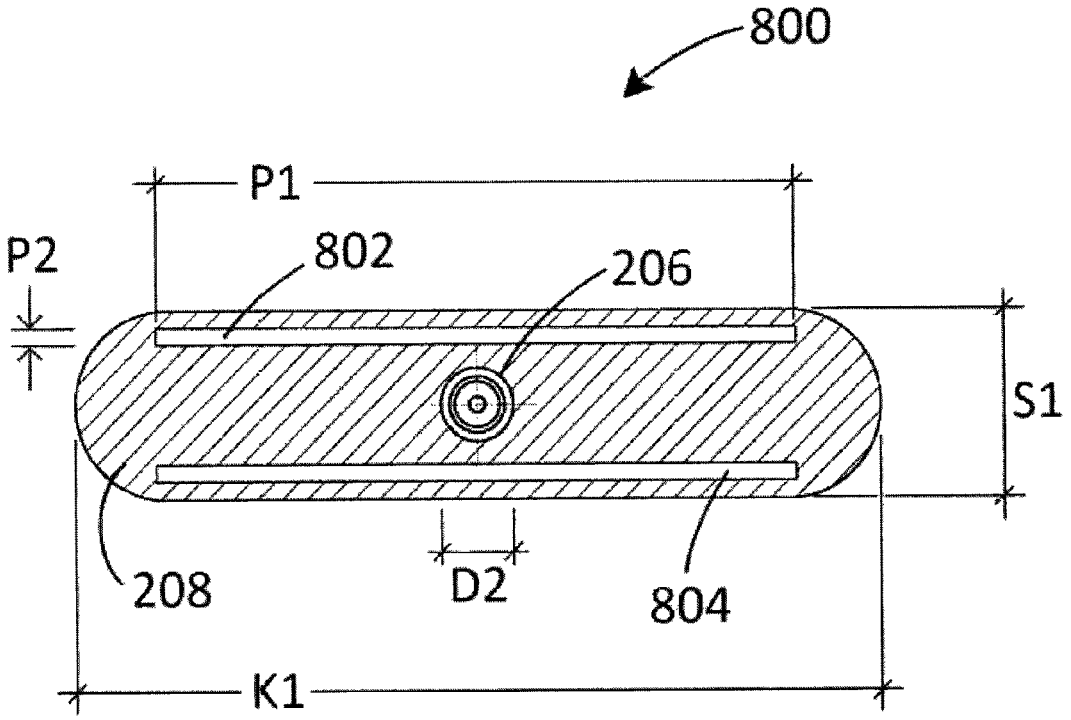
FIG. 8 shows a first alternative cableway cross-section.

FIG. 8 shows an enlarged cross-sectional view of a first alternative cableway 800. In the embodiment shown, the jacket 208 is substantially flat having a thickness S1 suitable for location in narrow passages such as between a door and a door jamb or a window and a window sill. In an embodiment, the jacket thickness is in the range of about 2 to 5 mm. And, in an embodiment, the jacket thickness is about 3 mm.

A micro-coaxial cable 206 is centrally located in the jacket 208 of the cableway 800. Also embedded in the jacket are substantially parallel plates 802, 804 located to either side of the micro-coaxial cable. In an embodiment, the plate's longest side P1 is substantially parallel to the jacket's longest side indicated by dimension K1 and the plate's shortest side P2 is substantially parallel to the jacket's shortest side indicated by dimension S1.

The cableway width K1 is selected such that the outer jacket envelops the micro-coaxial cable and the plates. In an embodiment, the jacket width is in the range of about 1.2×D2 to 15×D2 where D2 is the outer diameter of the micro-coaxial cable 206. And, in an embodiment, the jacket width is in the range of about 10-14 mm. In yet another embodiment, the jacket width is about 12 mm.

Materials suited for use as jackets include flexible, non-conducting and abrasion resistant materials. A number of polymers, including one or more of rubber, silicon, PVC, polyethylene, neoprene, chlorosulphonated polyethylene, and thermoplastic CPE, are used in various embodiments.

Construction methods for integrating the jacket 208, plates 802, 804 and micro-coaxial cable 206 include any suitable method known to persons of ordinary skill in the art. In an embodiment, the jacket 208 envelops the plates and micro-coaxial cable as it is extruded from a die. In some embodiments (as shown), the jacket envelopes the plates and micro-coaxial cable and fills the spaces between them. In yet another embodiment, the assembly is molded such as by filling a mold holding the micro-coaxial cable and plate(s) with a fluid that will solidify and become the jacket. Suitable fluids include fluids useful in making the above polymers and other fluids useful for making suitable jacket materials and known to persons of ordinary skill in the art.

Micro-coaxial cables suitable for use with the cableway 800 include cables similar to those described in connection with FIG. 4 above.

Protection for the micro-coaxial cable 206 is provided by the plates 802, 804. The plates bear and/or spread transverse loads applied to the cableway 800 and tend to prevent harmful compression of the micro-coaxial cable. In various embodiments, the thickness of the plates is in the range of 5 to 50 percent of the diameter of the micro-coaxial cable.

Materials suited for plate construction are relatively incompressible as compared to the jacket materials. In some embodiments, plate construction materials are flexible. And, in some embodiments rail construction materials tend, at least partially, to retain deformed shapes such as an angular profile after being bent around an obstruction such as corner.

In various embodiments, plate construction materials include metals and metal alloys with one or more of iron, steel, copper, aluminum, tin, nickel and other metals known by persons of ordinary skill in the art to have suitable properties. In some embodiments, plate construction materials include non-metals such as polymers. For example, a segmented/articulated plate made from PVC can be used, the segments imparting flexibility and/or a tendency to retain, at least partially, a deformed shape.

In embodiments with conductive plate materials, the rails can serve as conductors. As persons of ordinary skill in the art will understand, the power handling capability of the rails will be influenced by their physical and material properties and the connectors will be chosen to suit the application.

Uses for the cableway 800 and assemblies including the cableway include passing through gaps at windows and doors, and through other confined spaces where an unprotected coaxial cable might otherwise be damaged. As discussed above, such protection is desirable for, inter alia, preserving signal quality. And, as discussed above, various embodiments orient one or more plates 802, 804 and a micro-coaxial cable 206 in a substantially flat cableway 800 such that the plates protect the micro-coaxial cable from transverse loads applied to the cableway.

Figure 9:
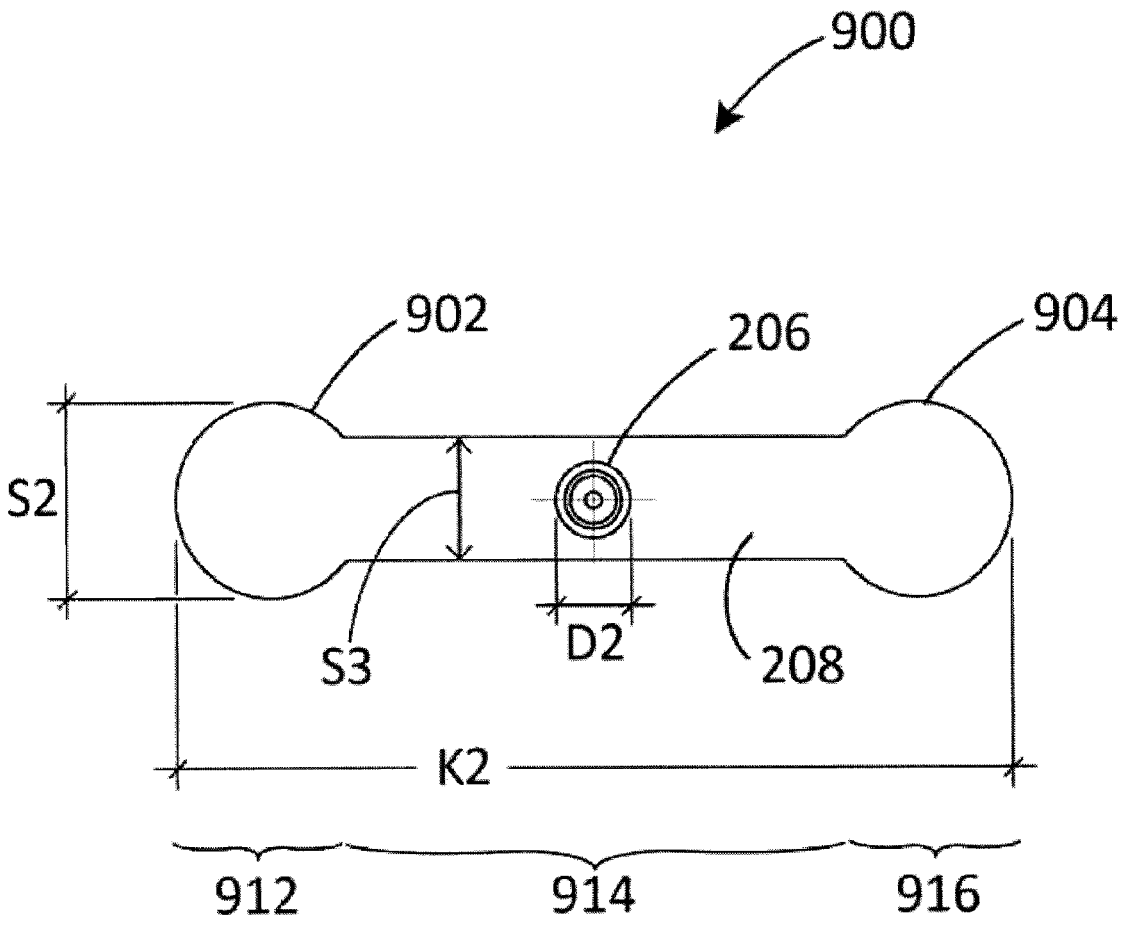
FIG. 9 shows a second alternative cableway cross-section.

FIG. 9 shows an enlarged cross-sectional view of a second alternative cableway 900. In the embodiment shown, a jacket 208 has multiple thicknesses S2, S3 suitable for location in narrow passages such as between a door and a door jamb or a window and a window sill. In an embodiment, the jacket thickness is in the range of about 2 to 5 mm.

A micro-coaxial cable 206 is about centrally located in the jacket 208 of the cableway 900. The jacket has a central section 914 including a portion with a thickness S3 bounded by peripheral sections 912, 916 including portions with a thickness S2. In an embodiment, the cableway cross-section is in the form of an "H." In another embodiment, the cableway cross-section has a "barbell" like shape with ends 902, 904 (as shown).

The cableway width "K2" is selected such that the outer jacket envelops the micro-coaxial cable and the plates. In an embodiment, the jacket width is in the range of about 4×D2 to 15×D2 where D2 is the outer diameter of the micro-coaxial cable 206. And, in an embodiment, the jacket width is in the range of about 10-14 mm. In yet another embodiment, the jacket width is about 12 mm.

Materials suited for use as jackets include flexible, non-conducting and abrasion resistant materials. A number of polymers, including one or more of rubber, silicon, PVC, polyethylene, neoprene, chlorosulphonated polyethylene, and thermoplastic CPE, are used in various embodiments.

Construction methods for integrating the jacket 208 and micro-coaxial cable 206 include any suitable method known to persons of ordinary skill in the art. In an embodiment, the jacket 208 envelops the micro-coaxial cable as it is extruded from a die. In some embodiments (as shown), the jacket envelopes the micro-coaxial cable and fills the spaces between them. In yet another embodiment, the assembly is molded such as by filling a mold holding the micro-coaxial cable with a fluid that will solidify and become the jacket. Suitable fluids include fluids useful in making the above polymers and other fluids useful for making suitable jacket materials and known to persons of ordinary skill in the art.

Micro-coaxial cables suitable for use with the cableway 900 include cables similar to those described in connection with FIG. 4 above.

Protection for the micro-coaxial cable 206 is provided by the peripheral sections 912, 914 having a thickness S2 greater than the central section thickness S3. The increased thickness sections bear and/or preferentially bear transverse loads and tend to prevent harmful compression of the micro-coaxial cable.

Uses for the cableway 900 and assemblies including the cableway include passing through gaps at windows and doors, and through other confined spaces where an unprotected coaxial cable might otherwise be damaged. As discussed above, such protection is desirable for, inter alia, preserving signal quality. And, as discussed above, peripheral portions of the jacket 912, 916 have relatively greater thickness as compared with a central jacket portion 914 such that the increased thickness portions protect the micro-coaxial cable from transverse loads applied to the cableway.

Figure 10:
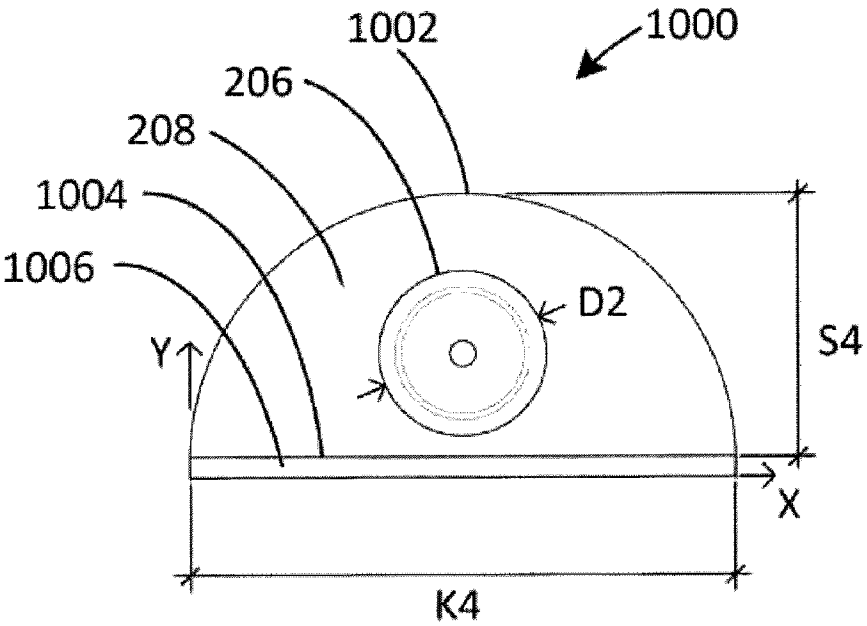
FIG. 10 shows a third alternative cableway cross-section.

FIG. 10 shows an enlarged cross-sectional view of a third alternative cableway 1000. In the embodiment shown, a jacket 208 has a curved surface 1002 and a thickness S4. In some embodiments, the dimension S4 approximates a radius of the jacket's curved surface. The jacket thickness S4 enables the cableway to be located in narrow passages such as between a door and a door jamb or a window and a window sill. In some embodiments, the jacket thickness is in the range of about 2 to 5 mm.

In addition to a curved surface 1002, the jacket 208 has a substantially flat surface 1004 that adjoins a plate 1006 similar to the plate 804 above. In various embodiments, the jacket is attached to the base plate 1006 by one or more of an adhesive, melting a portion of the jacket, casting a fluid jacket atop the base plate, and other suitable methods known to persons of ordinary skill in the art.

In an embodiment, the cableway cross-section 1000 is in the form of a "D" with the plate 1006 lying along its flat side (as shown).

The cableway width "K4" is selected such that the outer jacket envelops the micro-coaxial cable. In some embodiments, the jacket width is in the range of about 3×D2 to 15×D2 where D2 is the outer diameter of the micro-coaxial cable 206. And, in some embodiments, the jacket width is in the range of about 7.5-14 mm. In one embodiment, the jacket width is about 12 mm.

Materials suited for use as jackets include flexible, non-conducting and abrasion resistant materials. A number of polymers, including one or more of rubber, silicon, PVC, polyethylene, neoprene, chlorosulfonated polyethylene, and thermoplastic CPE, can be used in various embodiments.

Construction methods for integrating the jacket 208 and micro-coaxial cable 206 include any suitable method known to persons of ordinary skill in the art. In an embodiment, the jacket 208 envelops the micro-coaxial cable as it is extruded from a die. And, in some embodiments, the jacket envelopes the micro-coaxial cable 206 and fills the spaces between them. In yet another embodiment, the assembly is molded such as by filling a mold holding the micro-coaxial cable with a fluid that solidifies and becomes the jacket. Suitable fluids include fluids useful in making the above polymers and other fluids useful for making suitable jacket materials known to persons of ordinary skill in the art.

Micro-coaxial cables suitable for use with the cableway 1000 include cables similar to those described in connection with FIG. 4 above. Protection for the micro-coaxial cable 206 is provided by the jacket 208 having a thickness S4 greater than the micro-coaxial cable diameter D2. Loads applied to the jacket are spread so as to reduce resulting loads borne by the micro-coaxial cable and compression of the micro-coaxial cable.

Uses for the cableway 1000 and assemblies including the cableway include passing through windows, doors and other confined spaces where an unprotected coaxial cable might otherwise be damaged. As discussed above, the jacket 208 spreads loads applied to the cableway to limit micro-coaxial cable compression. And, as discussed above, such protection is desirable for, inter alia, preserving signal quality.

Figure 11:
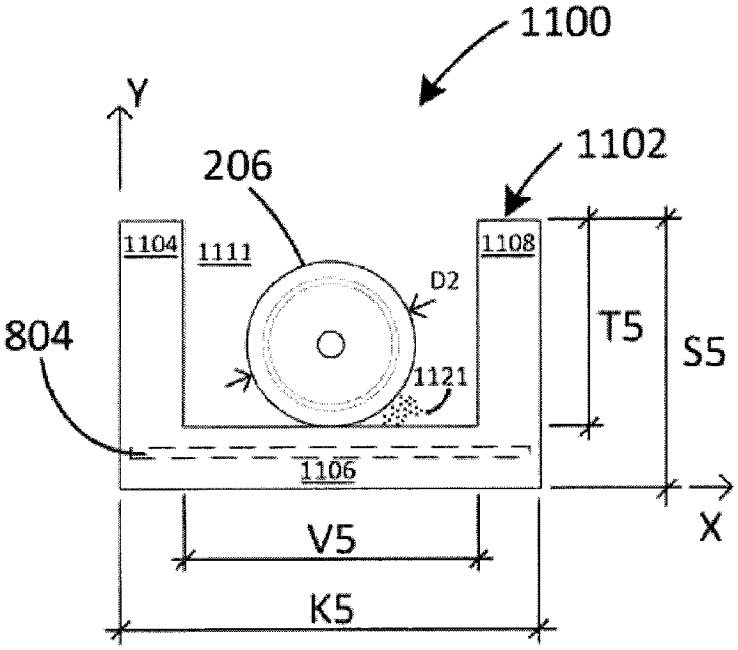
FIG. 11 shows a fourth alternative cableway cross-section.

FIG. 11 shows an enlarged cross-sectional view of a fourth alternative cableway 1100. In the embodiment shown, the cableway includes a micro-coaxial cable 206 positioned within a pocket 1111 of a "U" shaped conduit 1102. The conduit includes two arms 1104, 1108 coupled by a cross-member 1106 to form the pocket. In some embodiments, a plate 804 as described above is embedded in the cross-member. Conduit thickness and width are indicated by S5, K5 respectively and conduit pocket depth and width are indicated by T5, V5 respectively. In this embodiment, the micro-coaxial cable diameter is less than the depth of the conduit pocket D2<T5. The conduit thickness S5 enables the cableway to be located in narrow passages such as between a door and a door jamb or a window and a window sill. In an embodiment, the conduit thickness is in the range of about 2 to 5 mm.

In various embodiments, the conduit pocket depth and width T5, V5 are selected such that the micro-coaxial cable lies within the conduit pocket 1111 (as shown). In some embodiments, the conduit width K5 is in the range of about 2.5×D2 to 15×D2 where D2 is the outer diameter of the micro-coaxial cable 206. And, in some embodiments, the conduit width is in the range of about 6.25-14 mm. In one embodiment, the conduit width is about 12 mm.

Materials suited for use as conduits include flexible, non-conducting and abrasion resistant materials. A number of polymers, including one or more of rubber, silicon, PVC, polyethylene, neoprene, chlorosulfonated polyethylene, and thermoplastic CPE, are used in various embodiments.

Construction methods for integrating the conduit 1102 and micro-coaxial cable 206 include any suitable methods known to persons of ordinary skill in the art. In an embodiment, the micro-coaxial cable 206 is located in the conduit pocket 1111 after the conduit is extruded from a die. In various embodiments, the micro-coaxial cable is fixed within the conduit pocket, for example by fixing the micro-coaxial cable to an arm 1104, 1108 or cross-member 1106, and/or by partially or completely filling the pocket with a flexible material 1121. Suitable filling materials include fluids useful in making the above polymers and other fluids useful for making suitable conduit materials known to persons of ordinary skill in the art.

Micro-coaxial cables suitable for use with the cableway 1000 include cables similar to those described in connection with FIG. 4 above. Protection for the micro-coaxial cable 206 is provided by the conduit 1102 having a thickness S5 greater than the micro-coaxial cable diameter D2. Loads applied to the cableway 1100 are preferentially borne by the conduit and/or spread by the conduit to limit loads borne by the micro-coaxial cable and compression of the micro-coaxial cable.

Uses for the cableway 1100 and assemblies including the cableway include passing through gaps at windows and doors and through other confined spaces where an unprotected coaxial cable might otherwise be damaged. As discussed above, the conduit 1102 prevents and/or limits micro-coaxial cable compression. And, as discussed above, such protection is desirable for, inter alia, preserving signal quality.

Figure 12:
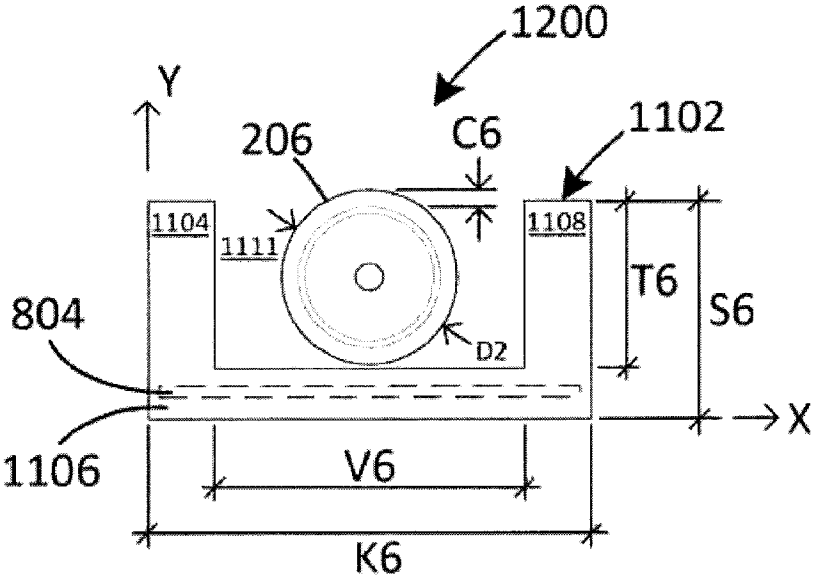
FIG. 12 shows a fifth alternative cableway cross-section.

FIG. 12 shows an enlarged cross-sectional view of a fifth alternative cableway 1200. In the embodiment shown, the cableway includes a micro-coaxial cable 206 positioned within a pocket 1111 of a "U" shaped conduit 1102. The conduit includes two arms 1104, 1108 coupled by a cross-member 1106 to form the pocket. In some embodiments, a plate 804 as described above is embedded in the cross-member. Conduit thickness and width are indicated by S6, K6 respectively and conduit pocket depth and width are indicated by T6, V6 respectively. In this embodiment, the depth of the conduit pocket is less than the diameter of the micro-coaxial cable T6<D2. In some embodiments, T6/D2×100% is greater than 80%. The conduit thickness S6 enables the cableway to be located in narrow passages such as between a door and a door jamb or a window and a window sill. In an embodiment, the conduit thickness is in the range of about 2 to 5 mm.

In some embodiments, the conduit width K6 is in the range of about 2.5×D2 to 15×D2 where D2 is the outer diameter of the micro-coaxial cable 206. And, in some embodiments, the conduit width is in the range of about 6.25-14 mm. In one embodiment, the conduit width is about 12 mm.

Materials suited for use as conduits include flexible, non-conducting and abrasion resistant materials. A number of polymers, including one or more of rubber, silicon, PVC, polyethylene, neoprene, chlorosulfonated polyethylene, and thermoplastic CPE, are used in various embodiments.

Construction methods for integrating the conduit 1102 and micro-coaxial cable 206 include any suitable method known to persons of ordinary skill in the art. In an embodiment, the micro-coaxial cable 206 is located in the conduit pocket 1111 after the conduit is extruded from a die. In various embodiments, the micro-coaxial cable is fixed within the conduit pocket, for example by fixing the micro-coaxial cable to an arm 1104, 1108 or cross-member 1106, and/or by partially or completely filling the pocket with a flexible material. Suitable filling materials include fluids useful in making the above polymers and other fluids useful for making suitable conduit materials known to persons of ordinary skill in the art.

Micro-coaxial cables suitable for use with the cableway 1200 include cables similar to those described in connection with FIG. 4 above. Under transverse loads (parallel to y-axis), limited deformation C6=(D2−T6) of the micro-coaxial cable 206 occurs prior to deformation of the conduit 1102. When deformation exceeds C6, the conduit also bears a portion of the load and tends to resist further deformation of both the conduit and the micro-coaxial cable.

Uses for the cableway 1200 and assemblies including the cableway include passing through windows, doors and other confined spaces where an unprotected coaxial cable might otherwise be damaged. As discussed above, the conduit 1102 tends to limit micro-coaxial cable transverse compression displacements greater than C6. And, as discussed above, such protection is desirable for, inter alia, preserving signal quality.

Figure 13:
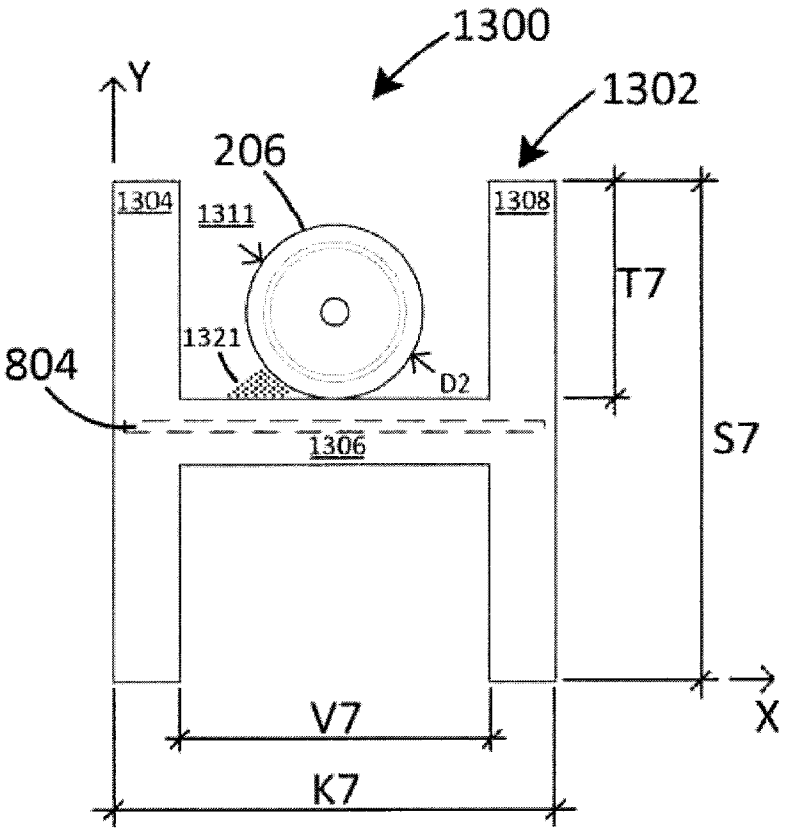
FIG. 13 shows a sixth alternative cableway cross-section.

FIG. 13 shows an enlarged cross-sectional view of a sixth alternative cableway 1300. In the embodiment shown, the cableway includes a micro-coaxial cable 206 positioned within an upper pocket 1311 of an "H" shaped conduit 1302. The conduit includes two flanges 1304, 1308 coupled by a cross-member 1306 to form the pocket. In some embodiments, a plate 804 as described above is embedded in the cross-member. Conduit thickness and width are indicated by S7, K7 respectively and conduit upper pocket depth and width are indicated by T7, V7 respectively. In this embodiment, the micro-coaxial cable diameter is less than the depth of the conduit pocket D2<T7. The conduit thickness S7 enables the cableway to be located in narrow passages such as between a door and a door jamb or a window and a window sill. In some embodiments, the conduit thickness is in the range of about 4-10 mm.

In various embodiments, the conduit pocket depth and width T7, V7 are selected such that the micro-coaxial cable lies within the conduit pocket 1311 (as shown). In some embodiments, the conduit width K7 is in the range of about 2.5×D2 to 15×D2 where D2 is the outer diameter of the micro-coaxial cable 206. And, in some embodiments, the conduit width is in the range of about 6.25-14 mm. In one embodiment, the conduit width is about 12 mm.

Materials suited for use as conduits include flexible, non-conducting and abrasion resistant materials. A number of polymers, including one or more of rubber, silicon, PVC, polyethylene, neoprene, chlorosulfonated polyethylene, and thermoplastic CPE, are used in various embodiments.

Construction methods for integrating the conduit 1302 and micro-coaxial cable 206 include any suitable method known to persons of ordinary skill in the art. In an embodiment, the micro-coaxial cable 206 is located in the conduit pocket 1311 after the conduit is extruded from a die. In various embodiments, the micro-coaxial cable is fixed within the conduit pocket, for example by fixing the micro-coaxial cable to an arm 1304, 1308 or cross-member 1306, and/or by partially or completely filling the pocket with a flexible material 1321. Suitable filling materials include fluids useful in making the above polymers and other fluids useful for making suitable conduit materials known to persons of ordinary skill in the art.

Micro-coaxial cables suitable for use with the cableway 1300 include cables similar to those described in connection with FIG. 4 above. Protection for the micro-coaxial cable 206 is provided by the conduit 1302 having a thickness S7 greater than the micro-coaxial cable diameter D2. Loads applied to the cableway 1300 are preferentially borne by the conduit and/or spread by the conduit to limit loads borne by the micro-coaxial cable and compression of the micro-coaxial cable.

Uses for the cableway 1300 and assemblies including the cableway include passing through windows, doors and other confined spaces where an unprotected coaxial cable might otherwise be damaged. As discussed above, the conduit 1302 prevents and/or limits micro-coaxial cable compression. And, as discussed above, such protection is desirable for, inter alia, preserving signal quality.

Figure 14:
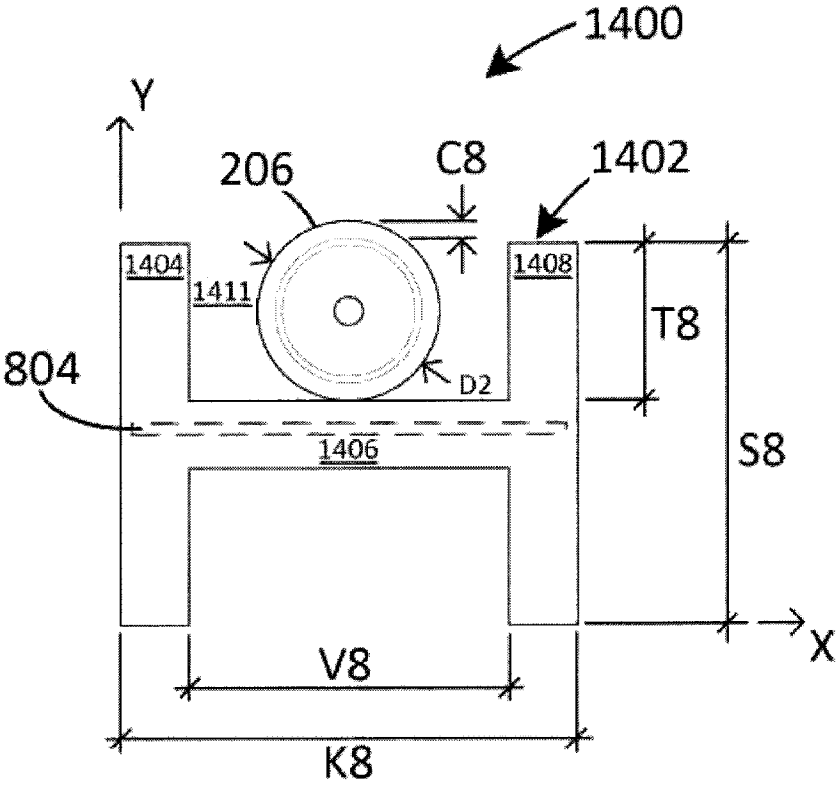
FIG. 14 shows a seventh alternative cableway cross-section.

FIG. 14 shows an enlarged cross-sectional view of a seventh alternative cableway 1400. In the embodiment shown, the cableway includes a micro-coaxial cable 206 positioned within a pocket 1411 of an "H" shaped conduit 1402. The conduit includes two arms 1404, 1408 coupled by a cross-member 1406 to form the pocket. In some embodiments, a plate 804 as described above is embedded in the cross-member. Conduit thickness and width are indicated by S8, K8 respectively and conduit pocket depth and width are indicated by T8, V8 respectively. In this embodiment, the depth of the conduit pocket is less than the diameter of the micro-coaxial cable T8<D2. In some embodiments, T8/D2×100% is greater than 80%. The conduit thickness S8 enables the cableway to be located in narrow passages such as between a door and a door jamb or a window and a window sill. In an embodiment, the conduit thickness is in the range of about 4 to 10 mm.

In some embodiments, the conduit width K8 is in the range of about 2.5×D2 to 15×D2 where D2 is the outer diameter of the micro-coaxial cable 206. And, in some embodiments, the conduit width is in the range of about 6.25-14 mm. In one embodiment, the conduit width is about 12 mm.

Materials suited for use as conduits include flexible, non-conducting and abrasion resistant materials. A number of polymers, including one or more of rubber, silicon, PVC, polyethylene, neoprene, chlorosulfonated polyethylene, and thermoplastic CPE, are used in various embodiments.

Construction methods for integrating the conduit 1402 and micro-coaxial cable 206 include any suitable method known to persons of ordinary skill in the art. In an embodiment, the micro-coaxial cable 206 is located in the conduit pocket 1411 after the conduit is extruded from a die. In various embodiments, the micro-coaxial cable is fixed within the conduit pocket, for example by fixing the micro-coaxial cable to an arm 1406, 1408 or cross-member 1406, and/or by partially or completely filling the pocket with a flexible material. Suitable filling materials include fluids useful in making the above polymers and other fluids useful for making suitable conduit materials known to persons of ordinary skill in the art.

Micro-coaxial cables suitable for use with the cableway 1400 include cables similar to those described in connection with FIG. 4 above. Under transverse loads (parallel to y-axis), limited deformation C8=(D2−T6) of the micro-coaxial cable 206 occurs prior to deformation of the conduit 1402. When deformation exceeds C8, the conduit also bears a portion of the load and tends to resist further deformation of both the conduit and the micro-coaxial cable.

Uses for the cableway 1400 and assemblies including the cableway include passing through gaps at windows and doors and through other confined spaces where an unprotected coaxial cable might otherwise be damaged. As discussed above, the conduit 1402 tends to limit micro-coaxial cable transverse compression displacements greater than C8. And, as discussed above, such protection is desirable for, inter alia, preserving signal quality.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A guarded coaxial cable comprising:
a micro-coaxial cable extending between rails;
a polymer jacket enclosing a length of the rails and micro-coaxial cable;
the jacket having first and second generally opposed surfaces for bearing transverse loads; and,
the rails, cable, and jacket being flexible and in combination operative to enable the guarded coaxial cable to substantially retain deformation consistent with bending the guarded coaxial cable around obstructions.

2. The guarded coaxial cable of claim 1 further comprising:
the rails chosen to resist deformation from transverse loads applied to the jacket to a greater degree than the micro-coaxial cable resists such deformation.

3. A guarded coaxial cable assembly comprising:
a micro-coaxial cable extending between two rails in spaced apart relationship;
a cableway formed from a polymer jacket enclosing the rails and the micro-coaxial cable;
the jacket having major and minor cross-sectional dimensions; and,
the rails, micro-coaxial cable, and jacket being flexible and in combination operative to enable the cableway to substantially retain deformations consistent with bending a flat side of the cableway around obstructions.

4. The coaxial cable assembly of claim 3 further comprising:
one or more rail fabrication materials chosen to resist deformation from transverse loads applied to the jacket to a greater degree than the micro-coaxial cable resists such deformation.

5. The coaxial cable assembly of claim 4 further comprising:
a coaxial connector terminating at least one end of the micro-coaxial cable.

6. The coaxial cable assembly of claim 5 wherein the coaxial connector is for mating with an F Type coaxial connector.

7. The guarded coaxial cable assembly of claim 4 further comprising:
a first female coaxial cable connector coupled to one end of the micro-coaxial cable; and,
a second female coaxial cable connector coupled to an opposed end of the micro-coaxial cable.

8. The guarded coaxial cable assembly of claim 7 wherein the thickness of the cableway jacket is less than 7 mm.

9. The guarded coaxial cable assembly of claim 8 wherein the width of the cableway jacket is greater than 10 mm.

10. A cableway with structural elements, the cableway comprising;
a micro-coaxial cable extending alongside a rail;
a polymer jacket encasing the micro-coaxial cable and the rail; and, the jacket having generally opposed bearing surfaces that define a cableway minor dimension therebetween;
wherein cableway deformations tending to fold a bearing surface are substantially maintained by the cableway structural elements.

11. The cableway of claim 10 further comprising:
a rail fabrication design chosen to resist deformation from transverse loads applied to the jacket to a greater degree than the micro-coaxial cable resists such deformation.

12. The cableway of claim 11 further comprising:
coaxial cable connectors terminating opposed ends of the cableway.

13. The cableway of claim 12 further comprising:
boots covering interfaces between the coaxial cable connectors and respective ends of the micro-coaxial cable.

* * * * *